US005285028A

United States Patent [19]

Umeda et al.

[11] Patent Number: 5,285,028

[45] Date of Patent: Feb. 8, 1994

[54] GROUP CONTROL METHOD AND APPARATUS FOR ELEVATORS FOR ASSIGNMENT OF COINCIDENT CALLS

[75] Inventors: Yasukazu Umeda; Shintaro Tsuji; Minoru Nakata; Koji Takeshima; Hidenobu Nakashima, all of Inazawa, Japan

[73] Assignee: Mitsubishi Denki Kabushiki Kaisha, Tokyo, Japan

[21] Appl. No.: 775,613

[22] Filed: Oct. 15, 1991

[30] Foreign Application Priority Data

Oct. 16, 1990 [JP] Japan ..... 2-275232

[51] Int. Cl.[5] ..... B66B 1/20

[52] U.S. Cl. ..... 187/126; 187/128

[58] Field of Search ..... 187/128, 126, 124, 125, 187/129

[56] References Cited

U.S. PATENT DOCUMENTS

| | | | |
|---|---|---|---|
| 3,743,057 | 7/1973 | Hall et al. | 187/125 |
| 4,026,389 | 5/1977 | Magee | 187/126 |
| 4,782,921 | 11/1988 | MacDonald et al. | 187/127 |
| 4,792,019 | 12/1988 | Bittar et al. | 187/125 |
| 4,804,069 | 2/1989 | Bittar et al. | 187/125 |
| 5,092,430 | 3/1992 | Goto et al. | 187/122 |

*Primary Examiner*—Steven L. Stephan
*Assistant Examiner*—Robert Nappi
*Attorney, Agent, or Firm*—Leydig, Voit & Mayer

[57] ABSTRACT

A group control method apparatus for elevators including a plurality of cars for serving floors divided into a plurality of sectors. The apparatus has a determination coincidental ride prevention section for assigning a hall call to one of the plurality of cars in such a manner that passengers from different ones of the sectors will not ride on the same car.

4 Claims, 6 Drawing Sheets

GROUP CONTROL METHOD AND APPARATUS FOR ELEVATORS FOR ASSIGNMENT OF COINCIDENT CALLS

BACKGROUND OF THE INVENTION

1. Field of the Invention

The present invention relates to a group control apparatus for elevators.

2. Description of the Related Art

Elevator systems are generally a kind of public transportation in which it is usual for an elevator car to convey various kinds of passengers at one time.

Frequency, buildings are shared by a plurality of tenants. Two of the tenants may have a particular relationship with each other, for instance, may be rival companies. Thus, it has become desirable that a person affiliated with one of such two tenants avoid riding on the same elevator car with someone affiliated with the other tenant. Although a group control apparatus for elevators that gives consideration to these circumstances has not yet come into use, some elevators in hotels provide a function which almost meet the above requirements.

For example, Japanese Patent Laid-Open No. 56-17874 discloses an elevator operating system in which a call button is provided in each room of the hotel. When the call button of one of the rooms is operated, and a hall call is subsequently registered, any other hall calls (if there are any) through other call buttons are prevented from being registered. Furthermore, even when there are a plurality of rooms on the same floor as the particular room, information on the arrival of an elevator car is given only to the particular room, so that the caller can avoid coming across others in the elevator hall.

However, the conventional system cannot be applied in exactly the same way for the purpose of preventing members of two rival companies, such as above, from riding coincidentally because such application cannot be realized for the following reasons (1) The circumstances of a large building are different from those of a hotel in that the registration of other hall call(s) ought not be prevented even when the prevention of an unwanted coincidental ride is desired. Therefore, it is necessary that the other hall call(s) be registered so that different elevator car(s) serve the other caller(s); and (2) A tenant of a building may occupy a plurality of floors of the building. Therefore, it is necessary that the cars be able to serve between the floors occupied by the same tenant while being unaffected by the prevention of coincidental inter-tenant rides.

SUMMARY OF THE INVENTION

The present invention has been constructed to solve the above-described problem. An object of the present invention is to provide a group control apparatus for elevators that is capable of performing control in such a manner as to allow persons affiliated with different tenants of a building to ride on different cars so that such persons can avoid riding on the same car at the same time.

In order to achieve the above object, according to the present invention, there is provided a group control apparatus for elevators including a plurality of cars for serving floors divided into a plurality of sectors, the apparatus comprising: coincidental ride prevention means for assigning a hall call to one of the plurality of cars in such a manner that passengers from different ones of the sectors will not ride on the same car.

DESCRIPTION OF THE PREFERRED EMBODIMENT

An embodiment of the present invention will now be described with reference to the accompanying drawings.

Figure 1:
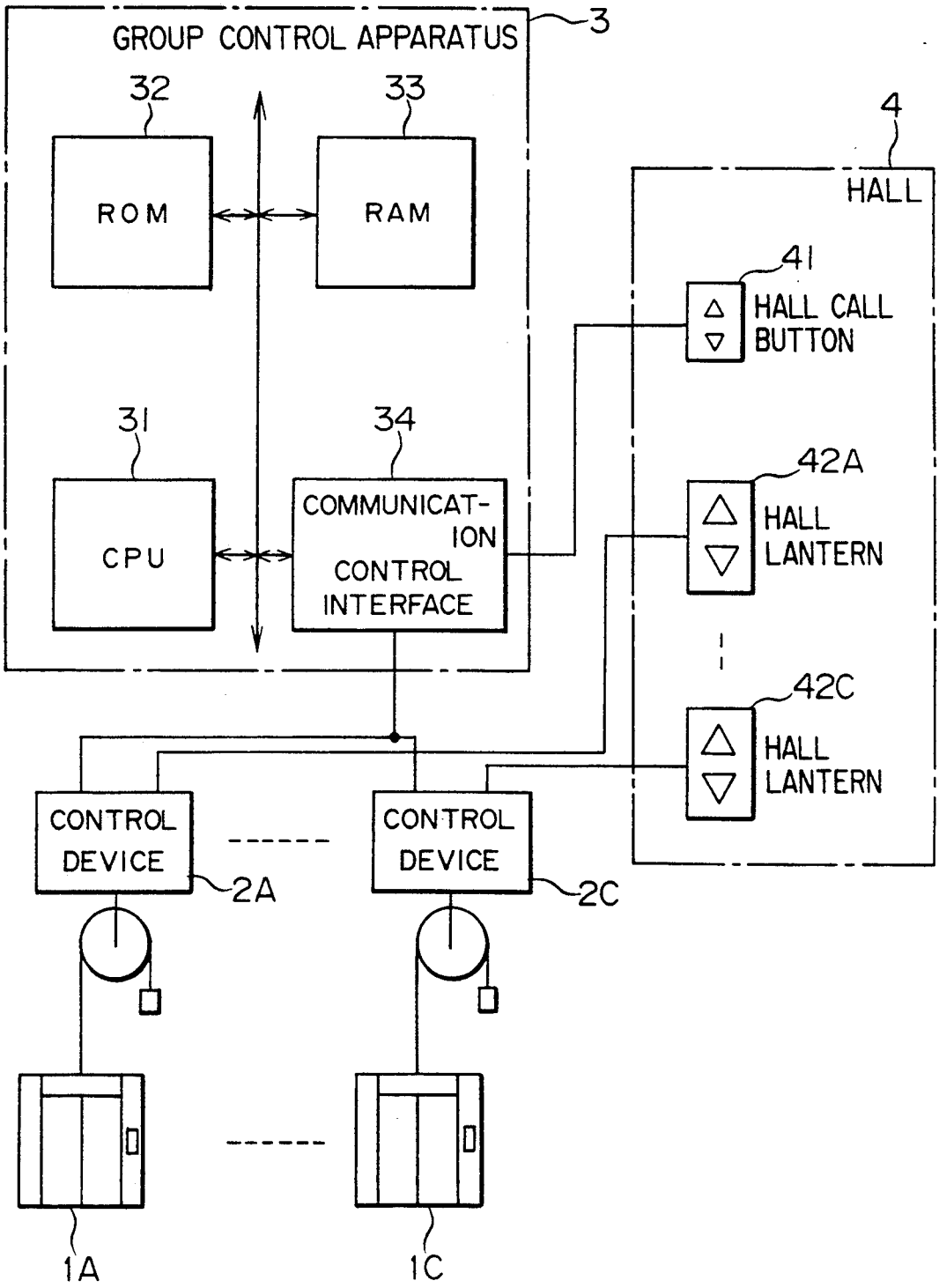
FIG. 1 is a block diagram showing an elevator system incorporating a group control apparatus according to one embodiment of the present invention.

Referring to FIG. 1, elevators A to C have cars 1A to 1C whose operation is respectively controlled by control devices 2A to 2C. Each of the control devices 2A to 2C is connected with a group control apparatus 3 for performing group control of the elevators A to C. The group control apparatus 3 has a CPU 31, a ROM 32 and a RAM 33 (both connected to the CPU 31), and a communication control interface 34 for performing communication with the control devices 2A to 2C. The communication control interface 34 of the group control apparatus 3 is connected to a hall call button provided in the elevator hall of each floor of the associated building. Each of the control devices 2A to 2C is connected to one of hall lanterns provided in the elevator hall of each floor. In order to simplify the illustration, FIG. 1 shows only a hall call button 41 (comprising a pair of button portions, i.e., upward and downward portions) and hall lanterns 42A to 42C (respectively corresponding to the control devices 2A to 2C) of an elevator hall 4 on the fifth floor of the building which has, for example, first to ninth floors (1F to 9F).

Figure 2A:
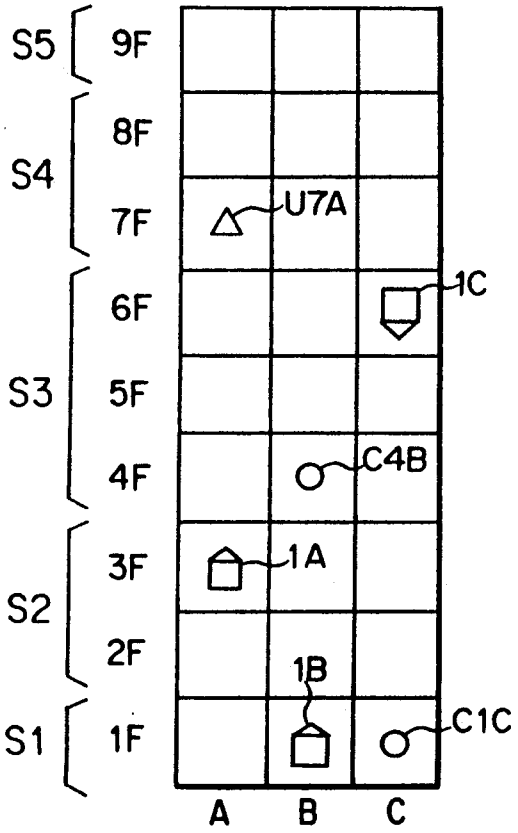
FIGS. 2A to 2E are views showing different operating conditions of the elevator system in the embodiment.
Figure 2B:
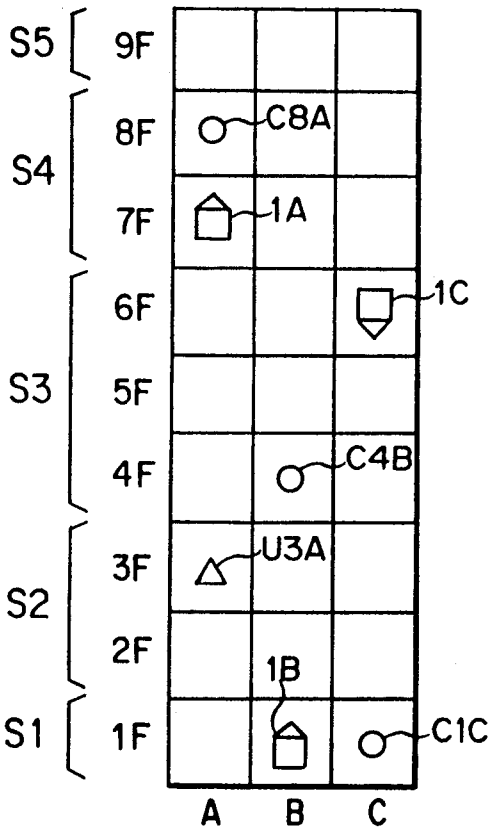
Figure 2C:
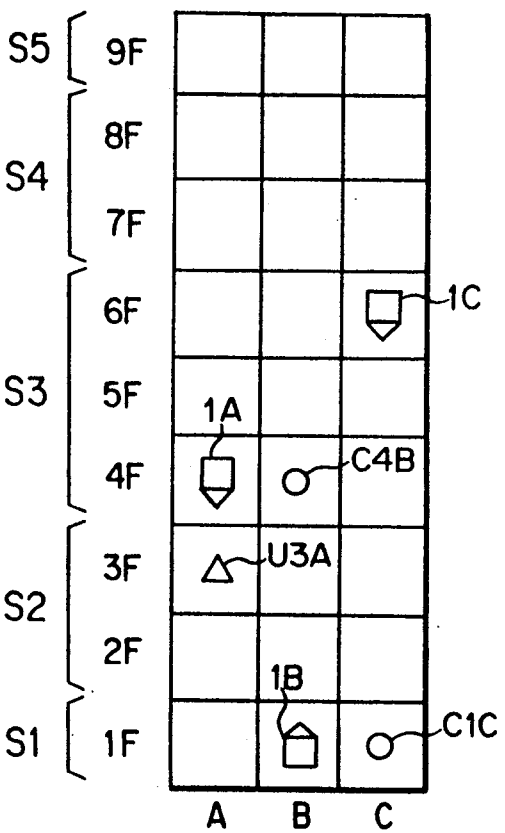
Figure 2E:
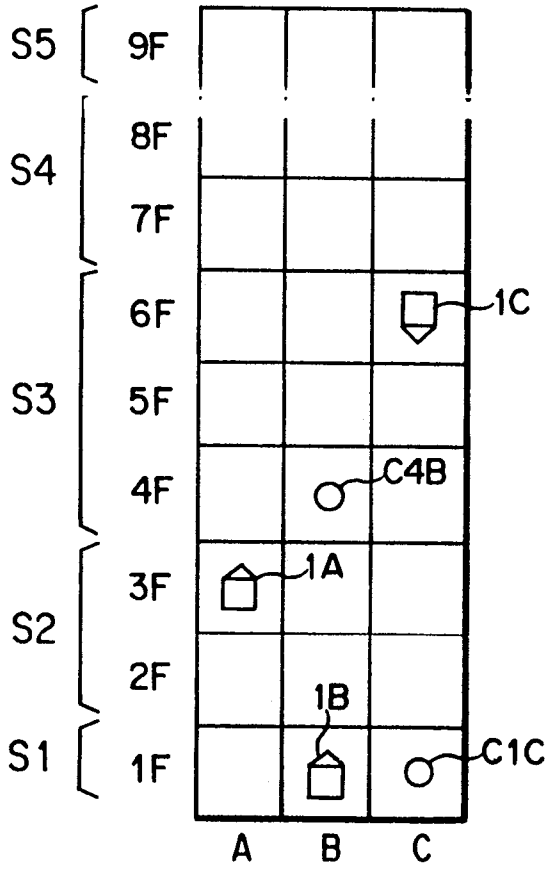
Figure 2D:
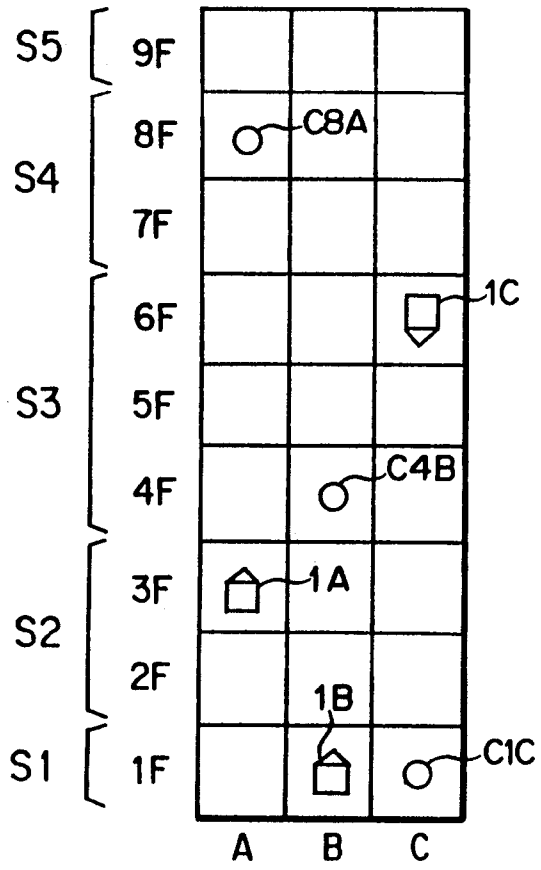

FIGS. 2A to 2E are views showing the relationship between the building and the elevators in this embodiment. These drawings show different operating conditions; however, the respective operating conditions of the car 1B of the elevator B and the car 1C of the elevator C (including the conditions of the call registration) remain the same throughout the drawings 2A to 2E. It is assumed that the first to ninth floors of the building belong to a plurality of sectors; 1F belongs to a first sector S1, 2F and 3F belong to a second sector S2, 4F through 6F belong to a third sector S3, 7F and 8F belong to a fourth sector S4, and 9F belongs to a fifth sector S5. This division of floors into sectors forms the basis on which it is determined whether or not a coincidental ride of passengers can take place. Specifically, passengers from the same sector can ride on the same car, but passengers from different sectors cannot ride on the same car. In FIGS. 2A to 2E, various symbols are used to indicate certain facts. The triangles attached to the cars IA to IC indicate the direction of the cars in which they are either moving or capable of moving: the car 1B in FIGS. 2A through 2E and the car 1A in FIGS. 2A, 2B, 2D and 2E are directed upward; and the car 1C in FIGS. 2A through 2E and the car IA in FIG. 2C are directed downward. In FIGS. 2A through 2E, the symbol C4B indicates a car call for the fourth floor already registered in the car 1B, while the symbol ClC indicates a car call for the first floor already registered in the car lC. In FIGS. 2B and 2D, the symbol C8A indicates a car call for the eighth floor already registered in the car IA. In FIG. 2A, the symbol U7A indicates an "upward" hall call from the seventh floor already assigned to the car IA. In FIGS. 2B and 2C, the symbol U3A indicates an "upward" hall call from the third floor already assigned to the car 1A.

Figure 3:
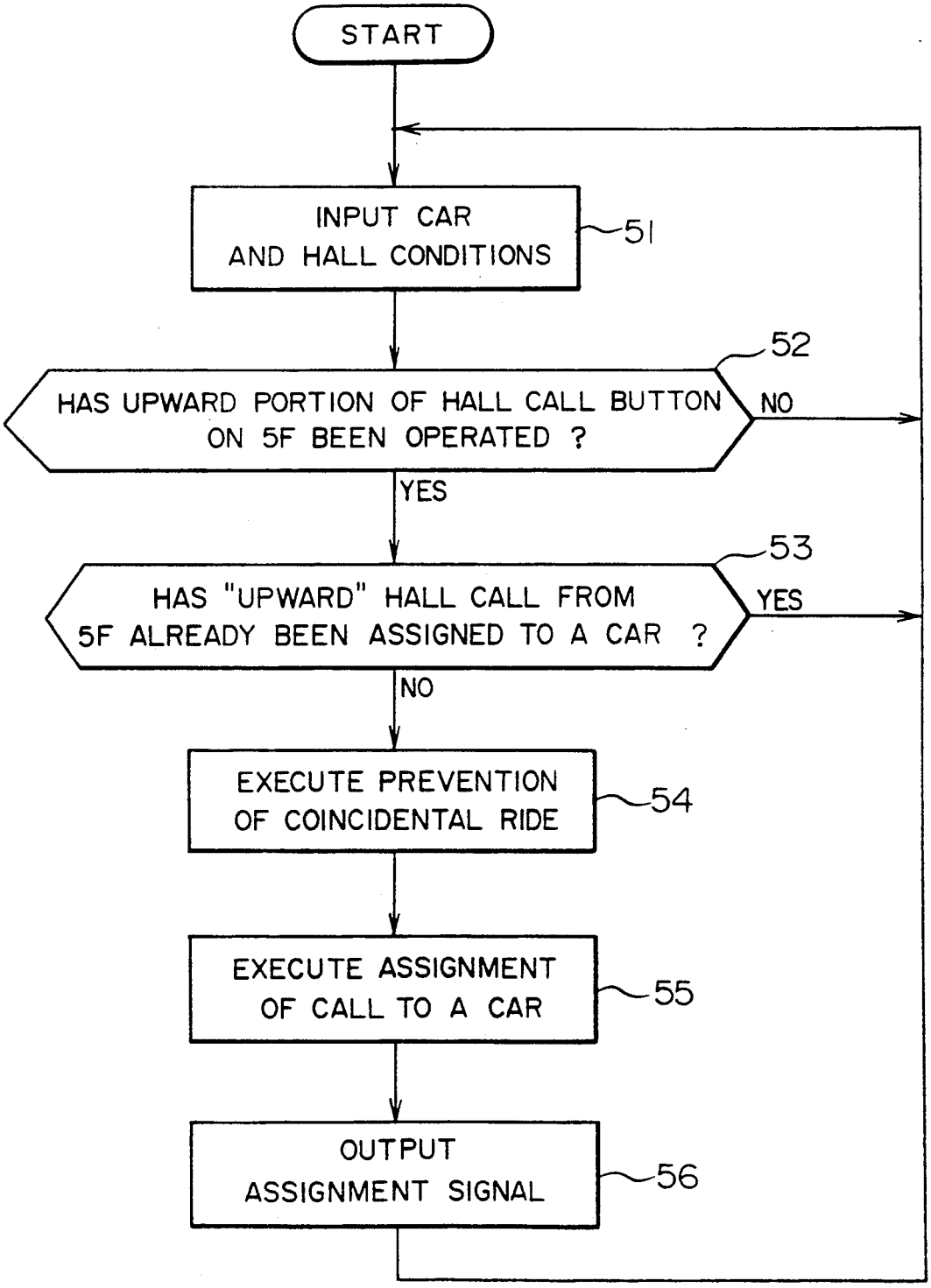
FIG. 3 is a flowchart showing the operation of the embodiment.

The operation of the embodiment will be described with reference to the flowcharts shown in FIGS. 3, 4 and 5.

Let us suppose that the upward portion of the hall call button 41 in the hall 4 of the fifth floor is operated. This hall condition is input, as one of the signals input to the group control apparatus 3, from the hall call button 41 via the communication control interface 34, and is stored in the RAM 33 (Step 51). In Step 51, in addition to the hall condition, the car condition is also input, and it includes the position of the cars, car calls, the moving direction of the cars, the stopped state of the cars, and certain calls already assigned to the cars.

Subsequently, in Step 52, it is determined whether or not the upward portion of the hall call button 41 has been operated If the answer to this question is "No", Step 51 is executed again. If the answer to the question of Step 52 is "Yes", Step 53 is executed, in which it is determined whether or not there is a car to which an "upward" hall call from the fifth floor has already been assigned. If, in Step 53, it is determined that there is a car to which a hall call having the above content has already been assigned, since there is no need to newly assign a car to the hall call just issued, the program returns to Step 51. If, in Step 53, it is determined that there is no car to which a hall call having the above content has been assigned, Step 54 is executed to effect a procedure for preventing coincidental rides.

Figure 4:
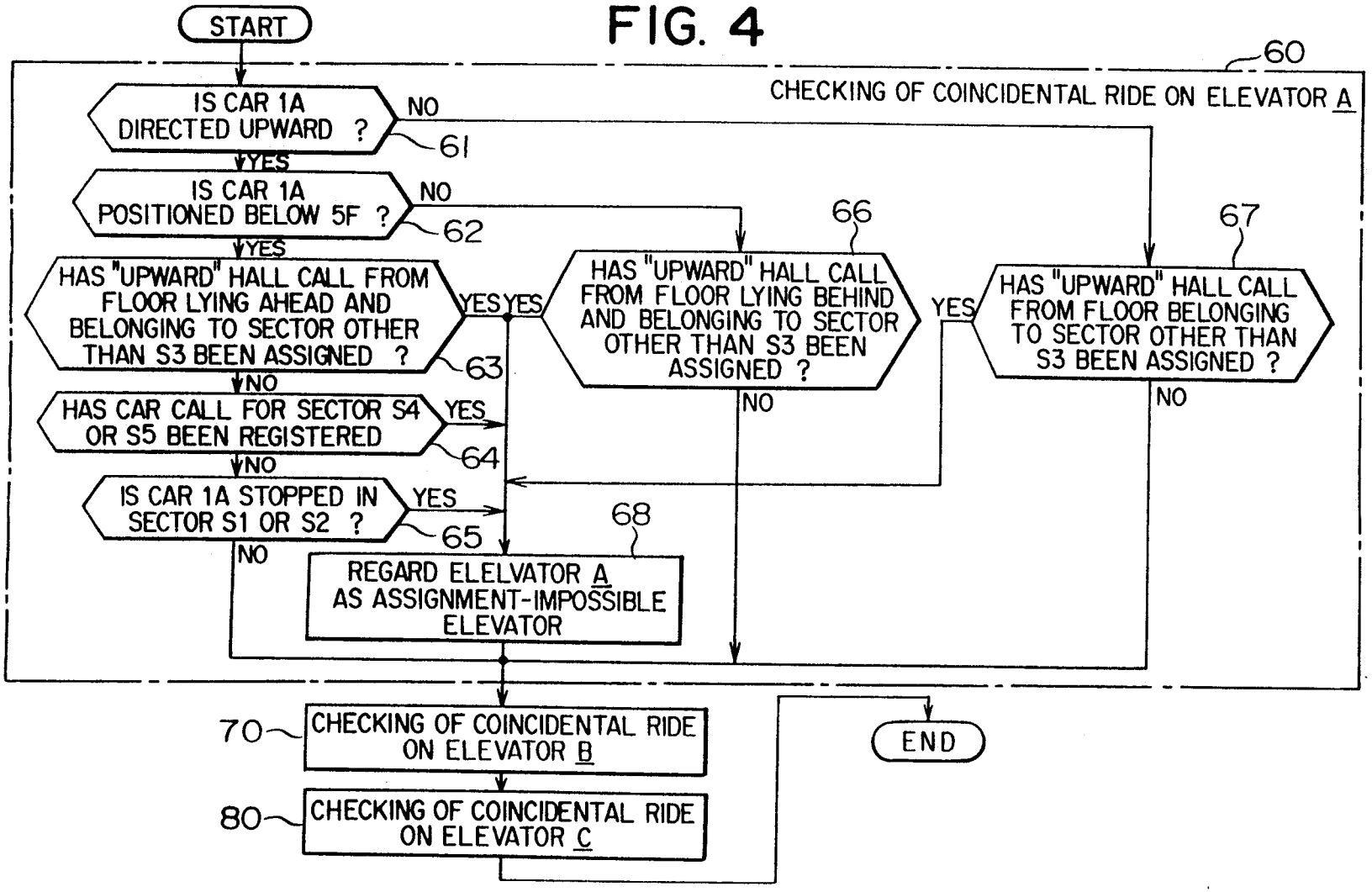
FIG. 4 a functional flowchart showing the details of Step 54 shown in FIG. 3.
Figure 5:
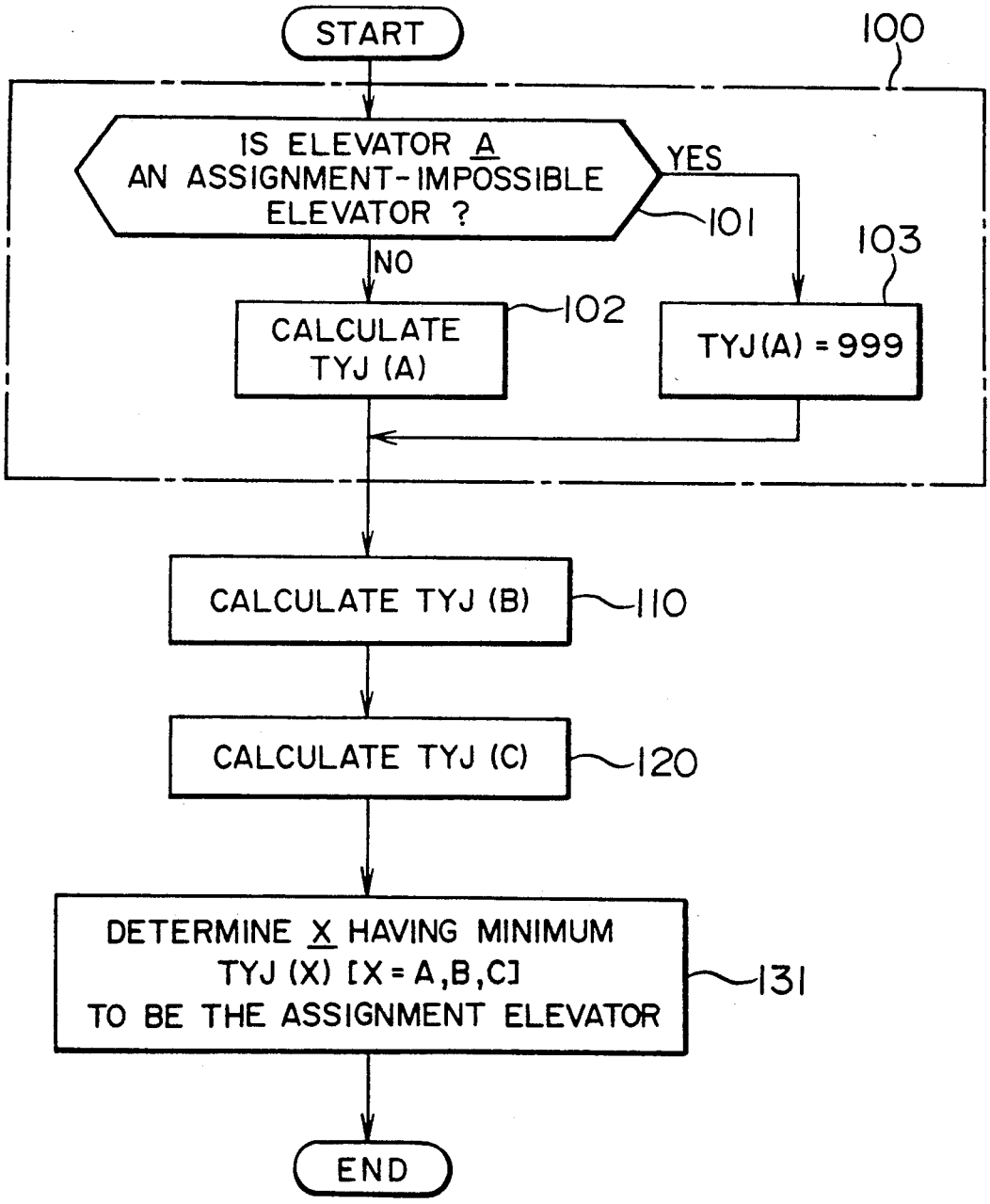
FIG. 5 a functional flowchart showing the details of Step 55 shown in FIG. 3.

Referring to FIG. 4, that is, a flowchart showing the details of the Step 54, Step 60 is first executed to check the possibility of the elevator A giving a coincidental ride to the caller on the fifth floor. Step 60 actually consists of eight sub-steps Steps 61 to 68. First, in Step 61, it is determined whether or not the car 1A is directed upward. If the answer to this question is "Yes", Step 62 is executed, in which it is determined whether or not the car 1A is positioned below the fifth floor. If the car 1A is positioned below the fifth floor, Step 63 is executed to determine whether or not any "upward" hall call issued from a floor lying ahead of the car 1A and belonging to a sector other than the third sector S3 has already been assigned to the car 1A. On the other hand, if the car 1A is positioned above the fifth floor, Step 66 is executed, in which it is determined whether or not any "upward" hall call issued from a floor lying behind the car 1A and belonging to a sector other than the third sector S3 has already been assigned to the car 1A.

If the determination of Step 63 is such that no hall call of the above-described kind has been assigned to the car 1A, Step 64 is executed, in which it is determined whether or not a car call for the fourth sector S4 or the fifth sector S5 has been registered. If no such car call has been registered, Step 65 is executed, in which it is determined whether or not the car 1A is stopped in the first sector S1 or the second sector S2.

If it is determined, in step 61, that the car 1A is not directed upward, Step 67 is executed, in which it is determined whether or not an "upward" hall call from a floor belonging to a sector other than the third sector S3 has been assigned to the car 1A.

If the determination in any of Step 63, Step 64, Step 65, Step 66 and Step 67 is "Yes", this means that, if the passenger or passengers from the fifth floor ride on the car 1A, they may have a coincidental ride with passenger(s) from a sector other than the third sector S3. Therefore, in each of these cases, the program proceeds to Step 68 in which the elevator A is determined to be an elevator to which the relevant hall call cannot be assigned. Thereafter, the program proceeds to Step 70 to check the possibility of the elevator B giving a coincidental ride. On the other hand, if the determination in any of Step 65, Step 66 and Step 67 is "No", the program proceeds to Step 70 without executing Step 68.

In Step 70, the possibility of the elevator B giving a coincidental ride is checked in exactly the same manner as that in the checking with respect to the elevator A in Step 60 except that Step 70 is concerned with the elevator B. Subsequently, the program proceeds to Step 80, in which a coincidental ride checking is performed in a similar manner with respect to the elevator C.

Let us suppose here that the respective conditions of the elevators A to C and the call condition are those shown in FIG. 2A. For instance, with respect to the elevator A, the car 1A is at the third floor, and is serving by moving upward. The "upward" hall call U7A from the seventh floor is already assigned to the car 1A. Under these conditions, therefore, the program proceeds from Step 61 to Step 62, and then to Step 63. Since the "upward" hall call U7A issued from the seventh floor (belonging to the fourth sector S4) has already been assigned to the car 1A, the determination of Step 63 is "Yes", and Step 68 is executed. In Step 68, it is determined that the relevant hall call cannot be assigned to the elevator A (that is, the elevator A is regarded as an assignment-impossible elevator).

Subsequently, in Step 70, a checking is made as to the possibility of the elevator B giving a coincidental ride. As shown in FIG. 2A, the car 1B of the elevator B is at the first floor, and is serving by moving upward. No hall call is assigned to the car 1B, and the car call C4B for the fourth floor belonging to the third sector S3 is registered in the car 1B. Under these conditions, therefore, the program performs checking by executing steps similar to Steps 61, Step 62, Step 63, Step 64 and Step 65 (these being steps in the checking with respect to the elevator A). In a step similar to Step 65, it is determined whether or not the car 1B is stopped in the first sector S1 or the second sector S2. If the car 1B just left the first floor, the elevator B is an elevator to which the relevant hall call can be assigned (that is, the elevator B is regarded as an assignment-possible elevator).

Subsequently, in Step 80, a checking is made as to the possibility of the elevator C giving a coincidental ride. As shown in FIG. 2A, the car 1C of the elevator C is at the sixth floor, and is serving by moving downward. No hall call has been assigned to the car 1C, and a car call C1C for the first sector S1 is registered in the car 1C. Under these conditions, therefore, the program performs checking by executing steps similar to Step 61 and Step 67. Thus, the elevator C is an elevator to which the relevant hall call can be assigned (that is, the elevator C is also regarded as an assignment-possible elevator).

As described above, in the operating condition shown in FIG. 2A, it is determined that the "upward" hall call from the fifth floor cannot be assigned to the elevator A because, if this call is assigned to the elevator A so that the caller on the fifth floor takes the car 1A, the passenger(s) from the fifth floor will ride on the same car with those passenger(s) from the seventh floor who have issued the "upward" hall call from the seventh floor.

When the execution of Step 54 (shown in FIG. 3) has been completed in this way, Step 55 is executed to assign the relevant hall call to one of the cars. In Step 55, Step 100 (shown in FIG. 5) is executed first to calculate an estimated period of time until arrival at the relevant floor with respect to the elevator A. As shown in FIG. 5, Step 100 actually consists of three sub-steps Step 101 to 103. Step 101 is first executed to determine whether or not the elevator A is regarded as an assignment-impossible elevator. If the elevator A is not regarded as an assignment-impossible elevator, Step 102 is executed, in which the estimated period of time until arrival TYJ (A) of the car 1A is calculated. If the elevator A is regarded as an assignment-impossible elevator, Step 103 is executed, in which the estimated period of time until arrival TYJ (A) is set at 999. Thus, the period of time is set at the maximum value so that the elevator A will not be determined to be the assignment elevator at Step 131, described later.

Similarly, an estimated period of time until arrival TYJ (B) with respect to the elevator B is calculated at Step 110 and, subsequently, an estimated period of time until arrival TYJ (C) with respect to the elevator C is calculated at Step 120. Thereafter, the elevator that has the minimum period of time until arrival is determined to be the elevator to which the relevant hall call is assigned.

If the respective conditions of the elevators A to C and the call condition are those shown in FIG. 2A, since the elevator A is regarded as an assignment-impossible elevator as a result of the above-described coincidental ride checking, in Step 100, the program proceeds from Step 101 to Step 103 where the estimated period of time until arrival TYJ (A) for the elevator A is set at 999, the maximum value. Subsequently, in Step 110, the estimated period of time until arrival TYJ (B) for the elevator B is calculated. The elevator B is not regarded as an assignment-impossible elevator. Accordingly, the TYJ (B) is calculated on the basis of the actual conditions in a step similar to Step 102 (this step being provided to calculate the TYJ (A)).

For example, if the calculation of TYJ (B) is performed under the conditions that one stop of an elevator car requires 10 seconds and that a movement of the car from one floor to an adjacent floor requires 2 seconds, the car 1B, which is positioned at the first floor and which has a car call C4B for the fourth floor registered therein, requires the following estimated period of time until it arrives at the fifth floor:

$$TYJ(B)=10\times1+2\times(5-1)=18(\text{sec})$$

Subsequently, in Step 120, the estimated period of time until arrival for the elevator C is calculated. Since the elevator C is not regarded an assignment-impossible car, either, the estimated period of time until arrival TYJ (C) is calculated on the basis of the actual conditions. If this calculation is performed under the same conditions concerning one stop and a floor-to-floor movement of an elevator car, the car 1C, which is positioned at the sixth floor and which has a car call ClC for the first floor registered therein, requires the following estimated period of time until it arrives at the fifth floor:

$$TYJ(C)=10\times1+2\times\{(6-1)+(5-1))=28(\text{sec})$$

(where the 10 seconds is the period required for the car to be stopped at the first floor before it moves upward)

Thus, as a result of the calculation of the estimated periods of time until arrival with respect to the elevators A, B and C, TYJ (A)=999, TYJ (B)=18 and TYJ (C)=28. In Step 131, the elevator B having the minimum estimated period of time until arrival is determined to be the elevator to which the relevant hall call should be assigned. Thus, the "upward" hall call from the fifth floor is assigned to the elevator B, which is the second to the elevator A in the light of the efficiency of service, in order to avoid a coincidental ride.

Finally, in Step 56 (shown in FIG. 3), an assignment signal is output to the control device corresponding to the elevator B. In order to indicate the assignment, the hall lantern corresponding to the elevator B is turned on. Thereafter, Step 51 is executed again. This time, however, since the "upward" hall call from the fifth floor has been assigned to the elevator B, the answer to the question of Step 53 is "Yes". Accordingly, even when the upward portion of the hall call button 41 of the fifth floor is again operated thereafter, no assignment of a car to the hall call takes place.

FIGS. 2B to 2E show other operating conditions where the elevator A is regarded as an assignment-impossible elevator, in other words, conditions where, if the "upward" hall call from the fifth floor is assigned to the elevator A, there is the possibility of passengers from different sectors coincidentally riding on the car 1A.

In the operating condition shown in FIG. 2B, an "upward" hall call from the third floor U3A has already been assigned to the car 1A. Accordingly, if the "upward" hall call from the fifth floor is assigned to the car 1A, the car 1A first answers a car call C8A for the eighth floor, then becomes reverses its direction to move downward to the third floor, stops at the third floor, and becomes reverses its direction to move upward to the fifth floor, and then stops at the fifth floor. Therefore, there is a possibility of passengers from different sectors (the second and third sectors) coincidentally riding on the car 1A. In this condition, the program proceeds from Step 61 to Step 62, then to Step 66, and then to Step 68 (all shown in FIG. 4); in Step 68, the elevator A is regarded as an assignment-impossible elevator.

In the operating condition shown in FIG. 2C, the car 1A is at the fourth floor, and is directed downward. Similarly to the case shown in FIG. 2B, since an "upward" hall call U3A from the third floor has already been assigned to the car 1A, there is a possibility of passengers from different sectors coincidentally riding on the car lA. In this condition, the program proceeds from Step 61 to Step 67, and then to Step 68; In Step 68, the elevator A is regarded as an assignment-impossible elevator.

In the operating condition shown in FIG. 2D, passengers(s) heading to the eighth floor belonging to the fourth sector S4 are already on the car 1A, and a car call C8A is already registered. If an "upward" hall call from the fifth floor is assigned to the car 1A, since the passenger(s) will still be on the car !A when it arrives at the fifth floor, they will ride on the car 1A coincidentally with those passenger(s) from the fifth floor belonging to the third sector S3. In this condition, the program proceeds from Step 61 to Step 62, then to Step 63 and Step 64, and then to Step 68; in Step 68, the elevator A is regarded as an assignment-impossible elevator.

In the operating condition shown in FIG. 2E, the car 1A is stopped at the third floor, and is directed upward. No car call has been registered yet, but there is a high possibility of passengers(s) riding on the car 1A; there is also the possibility of the car 1A moving to floor(s) above the fifth floor. Therefore, there is a possibility of passengers from different sectors having a coincidental ride. In this condition, the program proceeds from Step 61, to Step 62, then to Step 63, Step 64 and Step 65, and then to Step 68; In Step 68, the elevator A is regarded as an assignment-impossible elevator.

Under each of the operating conditions shown in FIGS. 2B to 2E, the elevator A is regarded as an assignmentimpossible elevator. Therefore, in each condition, in Step 55 (shown in FIG. 3), the relevant hall call is assigned to the elevator B, similarly to the case shown in FIG. 2A.

Although the above-described embodiment illustrates the case of an "upward" hall call, other kind of hall call may be processed in accordance with a substantially similar program. Needless to say, the number of floors in the associated building, the number of elevators in the elevator system, and the number of sectors are not limited to those shown in the foregoing embodiment.

Although the above-described embodiment illustrates a typical case of preventing a coincidental inter-sector ride when assigning a hall call to a car, the present invention is not intended to be limited to this example.

Although in the above-described embodiment, the elevator involving the possibility of a coincidental ride is excluded from the category of assignment-possible elevators, when a coincidental ride cannot be avoided under certain condition of service, the expectation of a coincidental ride may be added as a factor for assigning the relevant call to a car. For instance, when it is expected that the car of an elevator involves a coincidental ride, a penalty of thirty seconds is imposed on the elevator so that the estimated period of time until arrival for this particular elevator is increased by the penalty period, and then compared with the corresponding periods with respect to the other elevators. In this case, if it is estimated that the arrival of the car of this particular elevator is earlier than those of the cars of the other elevators by at least thirty seconds, the call is assigned to the particular elevator even though there is a possibility of a coincidental ride.

What is claimed is:

1. A group control apparatus for elevators including a plurality of cars for serving floors divided into a plurality of sectors, said apparatus comprising:

determination means for, when a first hall call has been issued from one of said floors, determining whether or not there is a car to; which a second hall call having the same destination sector as said first hall call has already been assigned; and coincidental ride prevention means for, when said determination means has determined that there is no car to which said second hall call has been assigned assigning said first hall call to one of said plurality of cars in such a manner that passengers from different ones of said sectors will not ride on the same car.

2. An apparatus according to claim 1 wherein said coincidental ride prevention means comprises:

coincidental ride checking means for determining whether or not each of said plurality of cars involves the possibility of passengers from different ones of said sectors having a coincidental ride if said first hall call is assigned to the car;

calculating means for calculating an estimated period of time until arrival to the floor from which said first hall call has been issued with respect to at least one car which said coincidental ride checking means has determined to involve no possibility of a coincidental ride; and assigning means for assigning, on the basis of the calculation by said calculating means, said first hall call to the car having the shortest estimated period of time until arrival.

3. A method for operating a plurality of elevator cars in a building, said method comprising the steps of:

dividing the building into a plurality of sectors, each sector comprising at least one floor;

detecting the presence of a hall call;

determining the traveling direction of each one of the plurality of cars;

determining the position of each one of the plurality of cars relative to the location of the hall call;

selecting cars suitable for assignment from among the plurality of cars, the cars suitable for assignment being cars not having passengers from sectors different from the sector of the hall call including each car that has not been assigned an inward hall call from a floor belonging to a sector other than the sector of the present call;

determining the estimated arrival time at the hall call floor for each of the cars suitable for assignment; and assigning the hall call to a car with the minimum estimated arrival time.

4. A method according to claim 3 wherein the cars suitable for assignment include each car that has not been assigned an upward hall call from a floor lying below and belonging to a sector other than the sector of the present call, where the car is positioned on or above a predetermined floor.

* * * * *